United States Patent [19]

Brandt

[11] 4,025,663

[45] May 24, 1977

[54] METHOD OF PRODUCING A TRANSLUCENT PANEL

[76] Inventor: James Chester Brandt, 64 S. Ionia Ave., Grand Rapids, Mich. 49502

[22] Filed: Apr. 7, 1975

[21] Appl. No.: 565,722

[52] U.S. Cl. ..... 427/161; 427/291; 427/297; 427/308; 427/386; 427/393; 427/397; 427/440; 428/38; 428/541; 240/108 B

[51] Int. Cl.[2] ..... B05D 5/00; B05D 3/00

[58] Field of Search ..... 427/161, 297, 308, 162, 427/440, 291; 428/38, 541; 240/108 B

[56] References Cited

UNITED STATES PATENTS

| | | | |
|---|---|---|---|
| 1,787,564 | 1/1931 | Bausch, Jr. | 427/161 X |
| 1,991,056 | 2/1935 | Mains | 428/541 X |
| 2,018,638 | 10/1935 | Driesen | 427/161 X |
| 2,352,740 | 7/1944 | Shannon | 427/308 |
| 3,077,417 | 2/1963 | Kenaga | 427/308 X |
| 3,077,418 | 2/1963 | Kenaga | 427/308 X |
| 3,077,419 | 2/1963 | Kenaga | 427/308 X |
| 3,077,420 | 2/1963 | Kenaga | 427/308 X |
| 3,779,797 | 12/1973 | Mäkinen | 427/297 |

FOREIGN PATENTS OR APPLICATIONS

| | | | |
|---|---|---|---|
| 205,029 | 1923 | United Kingdom | 240/108 B |
| 116,910 | 1918 | United Kingdom | 427/440 |

OTHER PUBLICATIONS

Simonds, H. & Ellis, C., *Handbook of Plastics*, fourth printing, New York, D. Van Nostrand Co., Inc., 1943, pp. 44, 48.

*Primary Examiner*—Ronald H. Smith
*Assistant Examiner*—Evan K. Lawrence
*Attorney, Agent, or Firm*—Glenn B. Morse

[57] ABSTRACT

A translucent panel is made up of one or more pieces of translucent wood. Each piece of wood is cut to less than one-half inch in thickness in the direction of the grain of the wood and is then impregnated with an initially liquid polymerizable material curable to a translucent solid. The influx of this material into the cells of the wood is induced by a sequence of intermiscible liquids, and/or by vacuum, with provision being made for the clearing of air bubble accumulation as the liquid displaces the entrained air in the wood. The absorbed material is cured so that the tubular cell structure of the wood is filled with a translucent solid, thereby causing the wood to become translucent. The completed panel is installed in proximity to a light source to form a light fixture.

8 Claims, 6 Drawing Figures

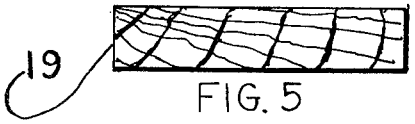
FIG. 5
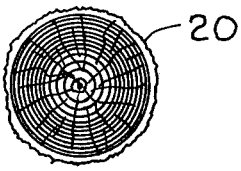
FIG. 6
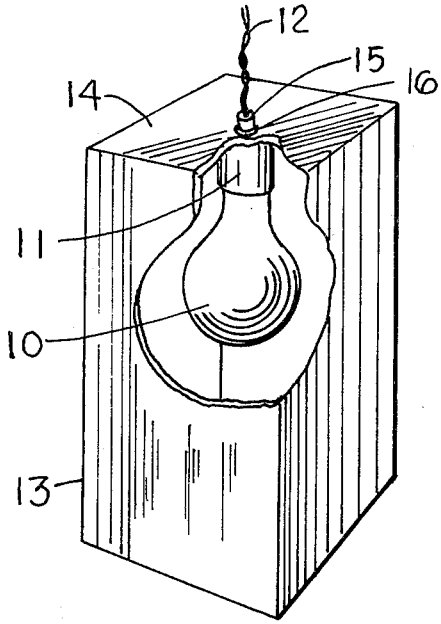
FIG. 1
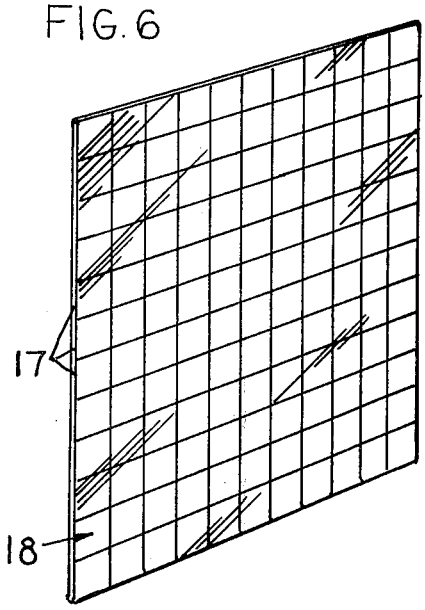
FIG. 2
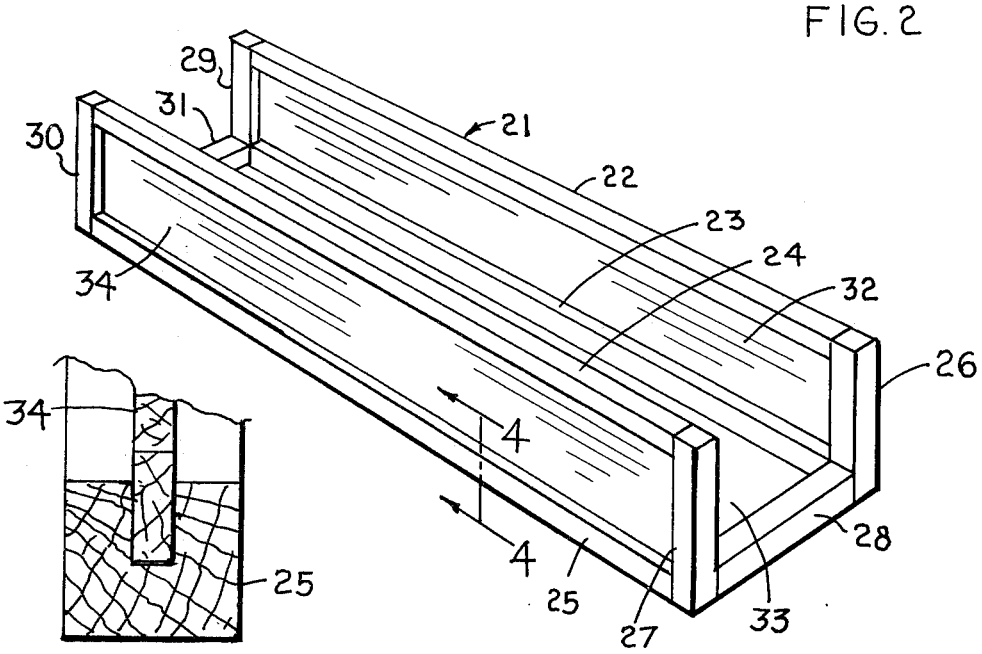
FIG. 4
FIG. 3

METHOD OF PRODUCING A TRANSLUCENT PANEL

BACKGROUND OF THE INVENTION

Light fixtures are commonly designed to provide a decorative affect, as well as a source of illumination. Interposing a translucent shade panel between the light source and the viewer results in the modification of the light as it traverses the shade panel. Thin fabrics, colored glass, and an endless variety of translucent materials have been used as shade panels in this type of fixture.

Natural wood has always been a favorite item in decorative materials, but its use in light fixtures has been limited to the base structure of the fixture, and in opaque shades. Natural wood is just not translucent, unless it is sliced almost paper-thin. This presents obvious problems in manufacture, and in the maintenance of the stability of the wood to prevent warping and other distortion. Wood may be impregnated with a variety of materials to maintain its structural integrity and appearance; but with wood cut parallel to the grain, such impregnation has little effect on translucence.

SUMMARY OF THE INVENTION

A translucent panel is formed by slicing pieces of wood to a thickness in the direction of the grain of less than one-half inch, and then impregnating the piece with an initially liquid polymerizable material that is translucent. The impregnation procedure results in the occupancy of the cells of the wood by the impregnating material, and the displacement of the original cell contents to accommodate this new material. Once the material has hardened, the pieces became translucent, apparently as a result of the well-known light-pipe effect, in which light admitted at one end of a solid transparent rod will be conducted along the rod to the opposite end, even though the rod may be bent into non-linear configurations. The light rays appear to be reflected internally from the surfaces of the elongated mass. The tubular cells of the wood, when occupied by the solid transparent material, seem to form these light-pipes. Methods are provided for inducing the inflow of material into the wood, and the resulting transparent pieces are incorporated in a shade panel as a light fixture.

DESCRIPTION OF THE DRAWINGS

FIG. 1 is a perspective view of a light fixture with the shade structure partially broken away to expose the interior light source.

FIG. 2 illustrates a typical form of panel that may be constructed of translucent pieces of wood.

FIG. 3 shows a shade for an elongated light source, such as a standard fluorescent tube.

FIG. 4 is a section on an enlarged scale at the plane 4—4 of FIG. 3.

FIG. 5 is a view of a typical wood board showing end grain.

FIG. 6 is a view of the end of a typical log.

DESCRIPTION OF THE PREFERRED EMBODIMENTS AND METHODS

The light fixture illustrated in FIG. 1 has a light source in the form of a standard incandescent light bulb 10 installed in a receptacle 11. The usual wiring 12 supplies electricity to the unit. A box-shaped shade 13 has an aperture in the top panel 14 for receiving the threaded extension 15, and the assembly is secured together by the nut 16. This form of assembly is standard. At least the side panels forming the box-shaped shade 13 are of the type shown in FIG. 2, in which a group of square or rectangular pieces 17 are secured together in edge-to-edge relationship to form a panel 18. The grain in the pieces 17 extends approximately perpendicularly to the face of the panel 18, which makes all of the pieces 17 appear as they would when viewed at the end of a board, as shown in FIG. 5 at 19. This configuration is a portion of the area appearing at the end of a log, as shown in FIG. 6 at 20.

FIG. 3 illustrates another form of light fixture, and particularly one that is useful with elongated light sources such as fluorescent tubes. The rectangular shade 21 is designed to surround a light source (not shown) of this type. The shade 21 consists of a frame by the members 22–31 which retain the panels 32–34. These are of the type illustrated in FIG. 2. A recommended, but by no means necessary, form of construction of the shade 21 is illustrated in FIG. 4. The frame members are grooved as shown to receive the panels in much the same way that a window frame receives a pane of glass. The panels 18 and 32–34 are all translucent. The light from the surrounded light source traverses these panels, and gives the viewer the feeling that he is looking through the pieces of wood, and seeing all their natural beauty.

The preparation of the panels to provide the necessary translucence is based upon the filling of the tubular cell structure of the wood with an initially liquid material that will set to a translucent solid. The resulting rod-shaped masses of translucent material function as light pipes, and conduct light from one side of the panel to the other, without regard for the linear or non-linear configuration of the particular cells that have been filled. The impregnation of the cells with the new material appears to be possible only from the open ends of the cells, and consequently can not be done effectively cross-grain. This has resulted in a procedure involving the slicing of thin pieces off the end of a board or log (or a laminate). These pieces are preferably on the order of a quarter of an inch in thickness in the direction of the grain. Two procedures have been found practical for inducing the translucent material to occupy the wood cells. In both of these, it appears that the limit in thickness (in the direction of the grain) appears to be approximately one-half inch, while retaining an acceptable degree of translucence. Some woods are more receptive than others to the process. The denser woods such as Honduras mahogany and oak do not provide as much translucence for a given thickness and process time when impregnated as to such lighter woods as pine or poplar. Some woods such as Peruvian mahogany, teak, and rosewood appear to have a cellular component or entrained liquid which interferes with the impregnation procedure, and limits it to extremely thin sections.

The procedure recommended for green wood is as follows:

1. Pieces of wood are sliced off to about a quarter of an inch in thickness measured parallel to the grain.

2. These pieces are soaked in a solvent, such as alcohol, for moisture and entrained liquids normally present in wood. For example, the pieces are soaked in methyl or ethyl alcohol (95%, preferred) at room temperature and pressure, and preferably with some degree of light agitation such as stirring. This is continued for approximately 16 hours as a minimum for the thinner pieces, and up to 40 hours for pieces up to a quarter of an inch.

3. The pieces are drained, and are immersed to a curable liquid resin which is at least translucent, if not transparent, when polymerized. In addition to the light-transmission characteristics of the impregnating material, it should be miscible in the solvent (e.g. alcohol). Since the solvent is also miscible with the cellular liquids in the wood, the result of the sequence of immersions is to bring the liquid impregnating material into the cell cavities as a result of the solubility. In this procedure, the cells are continuously occupied by liquids, and the matter of the displacement of air is not a major problem. The preferred materials for impregnating the pieces of wood include the transparent polyesters, styrene, some alkydurea mixtures, and also appear to include epoxy and acrylic materials. In any case, a suitable standard catalyst is used along with the curable resin or monomer to produce a setting time which will be long enough to permit the complete inflow of the liquid material before setting begins to take place. The length of time for the inter-solubility to take place to a sufficient degree to produce the necessary light transmission will vary with the thickness of the wood pieces, and with the particular monomer that has been selected. It appears that the liquid condition of the material should have a viscosity which is not over 500 centipoises. After the impregnation has been completed, the pieces are removed, drained, and cured according to the particular catalyst that has been selected.

The procedure recommended for kiln dried wood, or even for air-dried wood that has a fairly low moisture content, is as follows:

1. Pieces are sliced off the end of a log or board to approximately a quarter of an inch, or less, in thickness measured in the direction of the grain. Preferably, these should have a moisture content of less than ten percent. A laminate mass of wood composed of a group of boards can be assembled and glued together, so that a large panel of small end-grain pieces results from sawing off thin slabs from the end of the mass. These pieces may be matched for the design characteristics of the grain configuration as they are assembled prior to slicing. These pieces are preferably then sanded to an acceptable finish.

2. The sheets are set on edge in a resin solution, with the result that the tubular cells are approximately horizontal. This arrangement permits the air within the cells to proceed out in the form of bubbles, which are then free to move up to the surface, rather than accumulating on the panels to interfere with liquid penetration. The container of the monomer is then sealed, and subjected to a vacuum of approximately 20 inches of mercury. If the establishment of this degree of vacuum takes approximately five minutes, it will be found that the impregnation has been fairly well completed by that time. Bubbles will have appeared all over the pieces, and will have moved to the surface as foam, if the operation has been proceeding fairly rapidly. If the establishment of vacuum has been more rapid than this, it is very possible that the foaming action will present a problem that will limit the rapidity with which the vacuum can be applied. As the air is urged out of the cell structure by the presence of the vacuum, the liquid monomer (with its accompanying catalyst) moves into the cell structure by what appears to be a combination of capillary attraction and a sort of wicking action. This strongly suggests that the particular monomer selected have the capability of wetting the cell walls so that a concave meniscus will be present. This configuration established by surface tension tends to pull the liquid into the cell cavities.

3. The pieces are removed from the container (after releasing the vacuum), are drained, wiped, and permitted to care under the conditions dictated by the selective of the catalyst. After the cure has been completed, these pieces are preferably coated with some standard material to function as a moisture barrier, and possibly also for appearance purposes. The well-known tendency of wood to change its dimensional configuration with alternations of moisture content make this stabilization of the wood highly desirable. As an alternate procedure to the on-edge placement of the pieces within the liquid monomer, it has been found possible to float the pieces at the surface of the monomer, taking the precaution of preventing the liquid from wetting the top side. This permits the liquid to enter the capillary cells from underneath, and displace the air upwardly as the liquid enters. It is possible that in some portions of the cell structure, the process of osmosis may be involved in moving the impregnating monomer into the cell cavities. As a further alternate to the edge placement, the pieces may be placed in the liquid monomer in a random fashion, with a continuous movement of the monomer relative to the pieces which is sufficient to dislodge and flush off the accumulation of bubbles on the underside of the pieces. This can also be accomplished by regularly inverting the parts during the impregnating operation.

The economics of the process strongly suggests the use of slow-acting catalysts to preserve batch life. The accelleration of the cure can then be induced by the application of heat or ultraviolet radiation. The completed pieces can be handled as separate tiles, or maybe cast into a matrix or laminate. Where a group of these pieces are set in edge-to-edge relationship, and this group then cast into a transparent material, it is usually preferable to machine off the layer of the matrix material to re-expose the wood for the best decorative effect. To reduce the warping, a coating material should be selected that had a minimum tendency to contract on setting. Preferably, the coefficient of expansion with temperature should also be approximately equal to that of wood. The thinness of these panels strongly suggests that careful attention be used in selecting these coating materials to avoid this warping tendency.

I claim:

1. A method of producing a translucent panel comprising:

a. cutting at least one piece of wood to a thickness of less than one-half inch measured in the direction of the grain;

b. impregnating said piece with a solvent for moisture and entrained liquids normally present in wood;

c. draining said piece;

d. impregnating said piece with an initially liquid polymerizable material miscible in said solvent, curable to a translucent solid; said impregnations being carried out so that the wood cells are continuously occupied by liquids; and e. draining said piece and curing said material absorbed therein to fill the tubular cell structure of the wood with said translucent solid.

2. A method as defined in claim 1, wherein said material has a viscosity in the liquid state below five hundred centipoises.

3. A method as defined in claim 2, wherein the said solvent is an alcohol.

4. A method as defined in claim 3, wherein said piece is exposed to said solvent for at least 16 hours at room temperature and at atmospheric pressure.

5. A method of producing a translucent panel comprising:

a. cutting at least one piece of wood having a moisture content of less than 10% to a thickness less than one-half inch measured in the direction of the grain, b. impregnating said piece under vacuum with an initially liquid polymerizable material, curable to a translucent solid; said impregnating being carried out so that air is displaced from the wood cell structure and said cell structure is filled with said material; and c. draining said piece and curing the material absorbed therein to fill said cell structure with said translucent solid.

6. A method as defined in claim 5, wherein said material has a viscosity in the liquid state below 500 centipoises.

7. A method as defined in claim 10, wherein said piece is oriented in said material with the grain of said wood substantially horizontal.

8. A method as defined in claim 10, wherein said piece is floated on said material, with the top surface of said piece maintained free of said material.

* * * * *